US009115523B2

(12) United States Patent
Friesen et al.

(10) Patent No.: US 9,115,523 B2
(45) Date of Patent: Aug. 25, 2015

(54) DOUBLE END HINGE CONSTRUCTION FOR MULTIPLE ARTICULATING PANEL SECTIONAL DOORS

(71) Applicant: Raynor Mfg. Co., Dixon, IL (US)

(72) Inventors: Raymond J. Friesen, Mississauga (CA); Surinder Sambhi, Etobicoke (CA)

(73) Assignee: Raynor Mfg. Co., Dixon, IL (US)

( * ) Notice: Subject to any disclaimer, the term of this patent is extended or adjusted under 35 U.S.C. 154(b) by 17 days.

(21) Appl. No.: 13/693,679

(22) Filed: Dec. 4, 2012

(65) Prior Publication Data

US 2013/0276265 A1 Oct. 24, 2013

Related U.S. Application Data

(60) Provisional application No. 61/637,620, filed on Apr. 24, 2012.

(51) Int. Cl.
*E05D 15/24* (2006.01)

(52) U.S. Cl.
CPC ..... *E05D 15/242* (2013.01); *E05Y 2900/132* (2013.01); *Y10T 16/3828* (2015.01); *Y10T 16/558* (2015.01); *Y10T 16/5595* (2015.01); *Y10T 16/55988* (2015.01)

(58) Field of Classification Search
CPC ... E05D 15/242; E05D 13/1261; E06B 3/485; E06B 3/486
USPC ..... 16/DIG. 1, 97, 103, 91, 387, 389, 392; 160/201, 206, 210, 229.1, 236
See application file for complete search history.

(56) References Cited

U.S. PATENT DOCUMENTS

| | | | | |
|---|---|---|---|---|
| 1,660,266 | A | 2/1928 | Homer | |
| 1,897,391 | A | 2/1933 | Kelly | |
| 1,990,870 | A | 2/1935 | Kelly | |
| 2,059,585 | A | 11/1936 | Kelly | |
| 2,827,115 | A | 3/1958 | Stroup | |
| 2,869,637 | A | 1/1959 | Schacht, Jr. | |
| 2,980,182 | A | 4/1961 | Stroup | |
| 3,060,491 | A | 10/1962 | Pemberton et al. | |
| 3,376,913 | A * | 4/1968 | Clapsaddle | 160/201 |
| 4,095,641 | A | 6/1978 | Olson | |
| 4,115,900 | A | 9/1978 | Mihalcheon | |
| 4,119,133 | A | 10/1978 | Wolf | |
| 5,235,724 | A | 8/1993 | Perrin et al. | |
| 5,522,446 | A | 6/1996 | Mullet et al. | |
| 5,566,740 | A | 10/1996 | Mullet et al. | |

(Continued)

FOREIGN PATENT DOCUMENTS

NL 278210 11/1964

OTHER PUBLICATIONS

Notice of Allowance of U.S. Appl. No. 13/866,758, issued on May 7, 2014.

*Primary Examiner* — Jeffrey O Brien
(74) *Attorney, Agent, or Firm* — Banner & Witcoff, Ltd.

(57) ABSTRACT

A roller hinge assembly for connecting articulating door panels and simultaneously supporting a laterally extending panel support roller assembly includes multiple uniformly sized hinges having a male hinge strap and a female strap. Two or more such uniformly sized hinge units are arrayed laterally or side by side co-joined by a single hinge pin. Further, to insure appropriate alignment, a tubular roller bushing co-joins the male or the female hinge straps.

2 Claims, 1 Drawing Sheet

(56) References Cited

U.S. PATENT DOCUMENTS

| | | | | |
|---|---|---|---|---|
| 5,799,368 | A | 9/1998 | Young | |
| 5,884,363 | A | 3/1999 | Tofts | |
| 5,921,307 | A | 7/1999 | Ford et al. | |
| 5,934,352 | A | 8/1999 | Morgan | |
| 5,938,169 | A | 8/1999 | Ogawa et al. | |
| 5,954,111 | A * | 9/1999 | Ochoa | 160/201 |
| 6,006,817 | A | 12/1999 | Stone et al. | |
| 6,015,003 | A | 1/2000 | Switzgable | |
| 6,076,590 | A | 6/2000 | Ford et al. | |
| 6,082,046 | A | 7/2000 | Simmons | |
| 6,112,799 | A | 9/2000 | Mullet et al. | |
| 6,185,783 | B1 | 2/2001 | Carpinella | |
| 6,330,901 | B1 | 12/2001 | Friesen et al. | |
| 6,463,988 | B1 | 10/2002 | Mullet et al. | |
| 6,626,226 | B2 * | 9/2003 | Whitley | 160/236 |
| 6,640,872 | B1 | 11/2003 | Mullet | |
| 6,684,931 | B2 * | 2/2004 | Reimer et al. | 160/190 |
| 6,698,492 | B2 | 3/2004 | Lewis, Jr. | |
| 6,729,380 | B2 | 5/2004 | Whitley et al. | |
| 6,772,814 | B2 | 8/2004 | Leist et al. | |
| 6,843,300 | B2 | 1/2005 | Mullet et al. | |
| 6,968,886 | B2 | 11/2005 | Berry et al. | |
| 7,172,010 | B2 | 2/2007 | Welsh | |
| 7,178,197 | B2 | 2/2007 | Verheye, Sr. | |
| 7,201,207 | B2 | 4/2007 | Colston et al. | |
| 7,681,284 | B1 | 3/2010 | Schroeder | |
| 7,726,378 | B1 | 6/2010 | Savon | |
| 7,730,928 | B2 | 6/2010 | Stone et al. | |
| 7,866,368 | B2 | 1/2011 | Ostrovsky et al. | |
| 2002/0162189 | A1 * | 11/2002 | Whitley | 16/91 |
| 2004/0007334 | A1 | 1/2004 | Lewis, Jr. | |
| 2005/0011619 | A1 * | 1/2005 | Berry et al. | 160/229.1 |
| 2005/0155725 | A1 | 7/2005 | Verheye, Sr. | |
| 2005/0273976 | A1 | 12/2005 | Sarver | |
| 2008/0115416 | A1 | 5/2008 | Clark | |

* cited by examiner

DOUBLE END HINGE CONSTRUCTION FOR MULTIPLE ARTICULATING PANEL SECTIONAL DOORS

CROSS REFERENCE TO RELATED APPLICATION

This is a utility application incorporating by reference and claiming priority to provisional application Ser. No. 61/637,620 filed Apr. 24, 2012 entitled "Double End Hinge Construction for Multiple Articulating Panel Garage Doors".

BACKGROUND OF THE INVENTION

In a principal aspect the present invention relates to a hinge construction which is typically used in combination with a multi-panel, articulating overhead door construction wherein the panels are supported on rollers mounted in tracks positioned at the lateral sides of the panels.

The horizontal panels of articulating sectional doors are joined together by hinges positioned along the horizontal edges of the panels. The hinges, which are located at the lateral edges of the door panels, typically include a projecting axle with a roller mounted on a laterally projecting end. The roller fits in a track that guides the movement of the panels as the door moves from a vertical, closed door position to an open, overhead storage position within the building enclosure. The hinges utilized for such constructions are the subject matter of various patents including, by way of example, U.S. Pat. No. 5,235,724 entitled "Roller-Hinge Assembly for Retractable Overhead Door" issued Aug. 17, 1993. U.S. Pat. No. 5,235,724, which is incorporated herewith by reference, discloses a typical roller hinge construction or assembly that includes an upper or male hinge strap and a lower or female hinge strap pivotally connected by means of a pintle or hinge pin. Further, the female strap may include a bushing through which an axle of a roller assembly is inserted. The roller assembly is affixed for rotation to the end of the axle and is compatible with a track positioned laterally with respect to the side edge of the door panel.

While such constructions are useful, the design of the hinge may be impacted by the position or placement on the adjacent, horizontal door panels. That is, hinges positioned at the lateral edges are often subjected to additional stresses due to the fact that loads associated with the roller assembly, in addition to the stresses associated with hinging the door panels together, are placed on the hinge. In order to obviate or address such an issue, the end hinges may be oversized or multiple hinges may be positioned adjacent the lateral edges of the door. The hinges may be arranged in a way that they are engaged or ganged together to support a roller assembly.

Nonetheless, providing hinges to address the impact of stresses at the lateral edges of doors supported by a roller track present problems. For example, the hinges may result in higher cost because of the necessity to construct them especially for the purpose of addressing increased stress. Of course, higher material costs result in higher labor costs and may result in problems of installation inasmuch as the hinge assemblies are distinct and must be carefully arrayed and assembled in order to provide the necessary alignment of the hinges. Thus, not only the cost of materials, but the cost of installation may be higher. In addition, there may be structural disadvantages unless the hinges are properly aligned and carefully installed. Failure to carefully install such hinges may result in premature degrading of the door panels, or the roller guide track or the roller and the assembly associated with support of the doors along their lateral edges. Thus, there has developed a need for an improved roller hinge design.

SUMMARY OF THE INVENTION

Briefly, the present invention comprises a roller hinge assembly for connecting articulating door panels and simultaneously supporting a laterally extending panel support roller assembly. The hinge assembly comprises the utilization of multiple uniformly sized hinges having a male hinge strap or leaf and a female strap or leaf. Two or more such uniformly sized hinge assemblies or constructions are arrayed laterally or side by side one with respect to the other and co-joined by means of a single pin or pintle. Further, to insure appropriate alignment of the assembled hinges, a tubular roller bushing is employed to co-join the arrayed hinges and simultaneously serve as a single elongate housing for a roller axle. The tubular bushing, as well as the pintle or hinge pivot pin, are fastened or attached to the assembly of hinges to insure that they will remain joined together forming a composite hinge assembly which provides for uniform alignment and movement of the hinge leafs with respect to each other and also simultaneous, parallel alignment of the pivot axes of the hinge leaves and the bushing for the support roller axle that is fitted through the tubular bushing of the set of multiple hinge leafs.

Thus, an aspect of the invention is to provide a single size hinge assembly which may be utilized as a unitary hinge or compounded with other identical hinge assemblies using single and common bushings to join and maintain together the compound hinge assemblies which may then be used to support a panel roller assembly.

Another object and aspect of the invention is to provide a single standard hinge assembly, which has lower manufacturing and installation costs, but may be utilized as a single component or as part of a multicomponent hinge assembly.

A further aspect of the invention is to provide a hinge assembly which may include two or more standard hinge units wherein each unit is designed to be fastened to adjacent panels of a multi-panel sectional door to thereby insure complete and safe attachment and alignment of the panels and thus improve structural integrity and distribute the stresses associated with mounting the panels by means of a roller assembly.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF AN EMBODIMENT OF THE INVENTION

Figure 1:
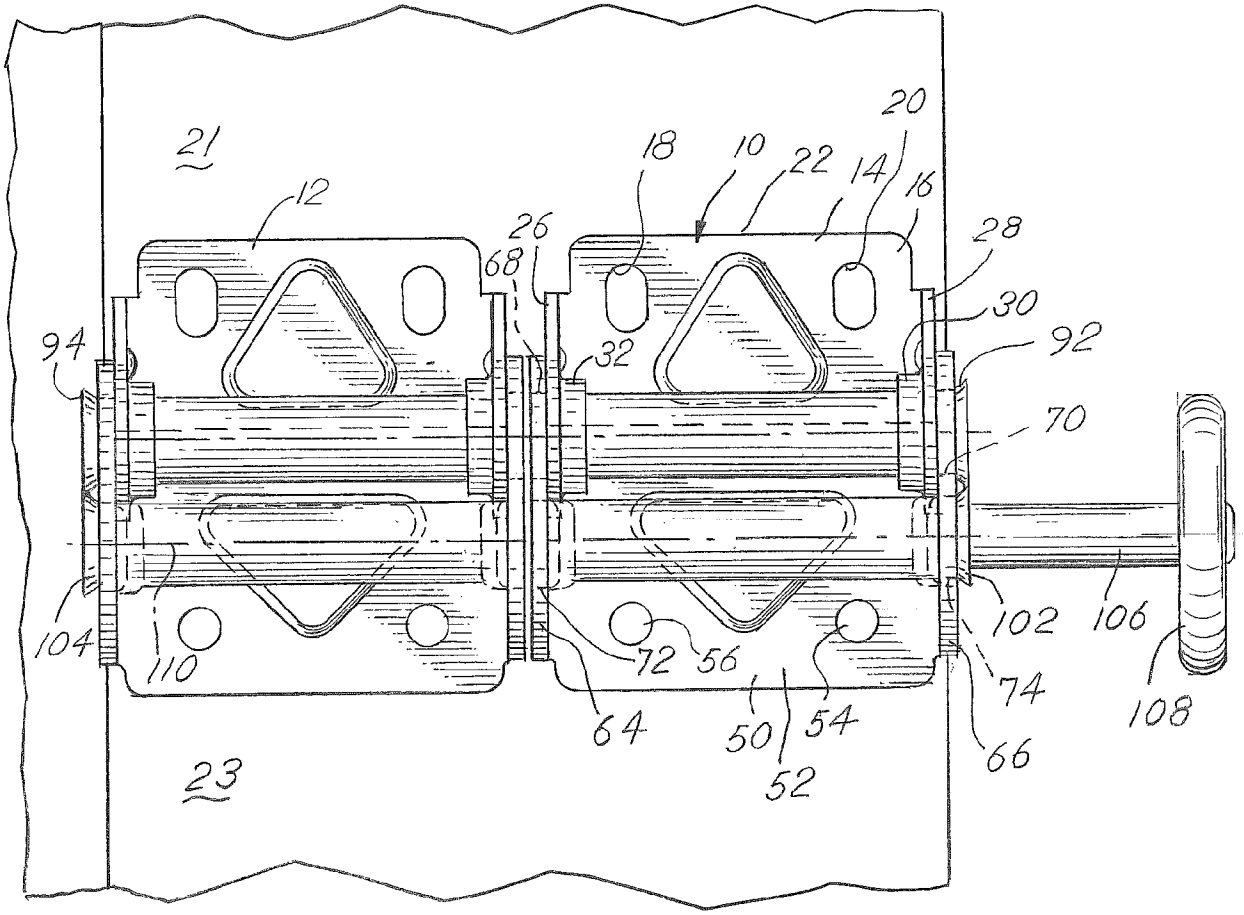
FIG. 1 is a top plan view of a composite hinge assembly incorporating two uniformly sized hinge units coupled by a single hinge pin or pivot pin or pintle and further coupled by a tubular bushing, both of which are fixed or pinned to the respective hinge units in a manner which couples the hinges and insures their attachment and alignment.
Figure 2:
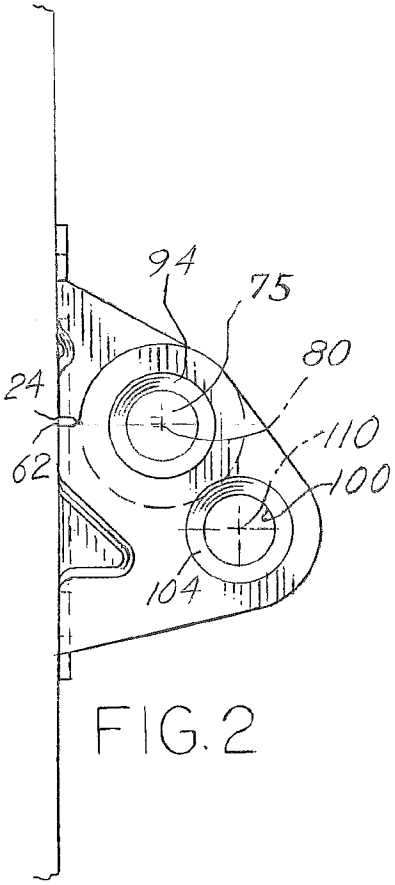
FIG. 2 is an end view of the assembly of FIG. 1.

Referring to the figures, the multiple unit hinge assembly includes a first hinge unit 10 and a substantially identical second hinge unit 12. Thus, a description of the first hinge unit 10 is applicable to the second hinge unit 12.

The first hinge unit 10 includes a planar, generally rectangular base 14 associated with a male hinge strap 16. The base 14 includes elongated fastener openings 18 and 20 to permit adjustment of the positioning of the hinge when it is attached by fasteners to a sectional door panel 21. The male hinge strap 16 further includes a front edge 22 and a back edge 24. The front edge 22 and the back edge 24 are generally parallel in the embodiment shown. Further, the male hinge strap 16 includes first and second transversely, upwardly extending support arms 26 and 28 at the opposite lateral sides of the base 14. The arms 26 and 28 are parallel and spaced one from the other. They each include a hinge pin or pintle passageway 30 and 32, respectively, formed therein. The openings 30 and 32 are aligned and define an axis 80 parallel to base 14. The upwardly extending support arms 26 and 28 are generally mirror images of each other.

The assembly or unit 10 further includes a female hinge strap 50 which includes a base 52 with fastener openings 54 and 56. Strap 50 further includes first and second spaced parallel, extending support arms 64 and 66 that extend transversely upwardly, normal to base 52. The support arms 64, 66 include aligned hinge pin or pintle passages 68 and 70. Further, the arms 64 and 66 include aligned openings 72 and 74 for receipt of a tubular axle bushing 100 described hereinafter.

The transverse arms 64 and 66 are spaced to slidably receive the arms 30 and 32 of the male hinge strap 16. Thus, the male hinge strap 16 may be articulated about axis 80 when the passages or openings 30, 32, 68 and 70 of the respective hinge straps 16 and 50 receive a hinge pin or pintle 75 to enable articulation. Adjacent, parallel sectional door panels 21, 23 are joined by the attached hinge straps 16, 50 fastened respectively to the adjacent panels 21, 23. The axis 80 of rotation of the hinge straps 16 and 50 and is defined by the center line axis of pin or pintle 75 which is fitted through the openings 68, 70, 30 and 32.

The passages 72, 74 of the respective hinges or hinge units 10 and 12 are also aligned and include a tubular bushing 100 extending therethrough along an axis of rotation 110. Bushing 100 is keyed or held in position by crimping 102 and 104 at the opposite ends. The tubular bushing 100 receives a shaft or axle 106 of a roller assembly having an end roller 108.

The second hinge assembly 12 is substantially identical to the first hinge assembly 10 in the embodiment depicted. Thus, the openings defining the axis 80 are aligned and the pintle or hinge pin 75 is inserted through those openings and keyed or formed at its opposite ends with a crimp 92 and 94 which holds the adjacent hinge leaves or hinge straps or units 10 and 12 joined together. As a result of this construction, the hinge units 10 and 12 are held together by pintle 75 and bushing 100 that each extend longitudinally along a first axis 80 and a second parallel axis 110 respectively. The parallel axes 80 and 110 insure uniform alignment of the hinge units 10, 12 and further because the pintle 75 and bushing 100 are crimped at their opposite ends, the hinge units 10 and 12 together, form a compact, easily manufactured assembly. That is, the pintle 75 and bushing 100, when so formed, enable adjacent support arms of adjacent female straps to be maintained in abutting relationship. The joiner of the hinge units 10, 12 is thus easily manufactured.

Also, more than two hinge units 10, 12 may be assembled as described. Further, the construction of hinge straps may be reversed to the extent that the unit 16 may be constructed as the female element and the unit 50 constructed as the male element. Various other features may be modified without changing the scope of the invention. Thus, while an embodiment of the invention has been described, the invention is limited only by the following claims and equivalents.

What is claimed is:

1. A roller hinge assembly for connecting articulating door panels and simultaneously supporting a laterally extending combination door panel support axle and roller, comprising in combination:

a first hinge unit and an adjacent, side by side, uniformly sized second hinge unit, each hinge unit including a male hinge strap and a female hinge strap, each strap including a generally planar base, a front base edge, a back base edge and spaced, parallel, transverse support arms located between said front base edge and said back base edge and extending upwardly from said base, said male strap and said female strap support arms of each unit comprising two pairs of strap support arms, each pair including axially aligned hinge pintle openings, said pintle openings of the first and second units having a single pintle axis passage for receipt of a single pintle, a pair of support arms of said first hinge unit adjacent and side by side to a pair of support arms of said second hinge unit to hinge said first and second hinge units for rotation about said pintle axis, one of said female strap support arms and said male strap support arms of said hinged first and second hinged units including axially aligned roller axle bushing openings having a single roller axle bushing axis passage for receipt of a single roller axle bushing, said male and female strap hinge pintle axis of said first and second hinge units aligned parallel to the roller axle bushing axis of said axle bushing openings of said first and second hinge units, each said base including fastener openings for attachment of the hinge units to separate, adjacent door panels;

a single pintle extending through the aligned pintle openings of said first and second hinge units, said single pintle having opposite outer ends which are crimped and fixed respectively to support arms of said first and second units thereby maintaining said first and second adjacent units joined together in axial, adjacent alignment whereby said hinge units are pivotal about the single pintle axis;

a single, generally tubular, roller axle bushing comprising a tube extending through said roller axle bushing openings and having opposite outer ends which are crimped and fixed respectively to the axially aligned roller axle bushing openings of said first and second hinge units; and a single roller support axle and roller combination, said roller axle axially positioned in said tube formed by said single roller axle bushing, said roller axle bushing tube and roller axle having a roller axle axis parallel to said bushing axis, and said pintle axis, said pintle and axle, in combination, maintaining said units in uniform parallel axis, adjacent, abutting alignment and as a single roller hinge assembly adapted to maintaining the units conjoined as a composite hinge assembly wherein the hinge straps maintain uniform alignment and movement coincident with said roller supported adjacent one of said hinge units for engagement in a roller track.

2. The assembly of claim 1 wherein each hinge strap front edge is parallel to the parallel axes.

* * * * *